US011417978B2

(12) United States Patent
Xie et al.

(10) Patent No.: US 11,417,978 B2
(45) Date of Patent: Aug. 16, 2022

(54) RF CONNECTOR COMPRISING A FLAT CENTRAL CONTACT WITH A FORK SHAPED END AND A SOLID INSULATING STRUCTURE CONFIGURED TO GUIDE A COMPLIMENTARY CONTACT PIN, APPLICABLE FOR USE IN A BOARD TO BOARD CONNECTOR

(71) Applicant: RADIALL, Aubervilliers (FR)

(72) Inventors: Guangrong Xie, Shanghai (CN); Kaiyang Yuan, Shanghai (CN)

(73) Assignee: RADIALL, Aubervilliers (FR)

( * ) Notice: Subject to any disclaimer, the term of this patent is extended or adjusted under 35 U.S.C. 154(b) by 0 days.

(21) Appl. No.: 16/955,361

(22) PCT Filed: Mar. 8, 2019

(86) PCT No.: PCT/CN2019/077537
§ 371 (c)(1),
(2) Date: Jun. 18, 2020

(87) PCT Pub. No.: WO2020/181429
PCT Pub. Date: Sep. 17, 2020

(65) Prior Publication Data

US 2021/0391663 A1 Dec. 16, 2021

(51) Int. Cl.
*H01R 13/11* (2006.01)
*H01R 13/646* (2011.01)
*H01R 13/631* (2006.01)

(52) U.S. Cl.
CPC ..... *H01R 13/112* (2013.01); *H01R 13/631* (2013.01); *H01R 13/646* (2013.01); *H01R 2201/16* (2013.01)

(58) Field of Classification Search
CPC ..... H01R 13/112; H01R 13/631; H01R 13/646–2201/16
See application file for complete search history.

(56) References Cited

U.S. PATENT DOCUMENTS 6,439,925 B1 8/2002 Lin et al.
9,799,969 B2 * 10/2017 Lee ..... H01R 4/60
(Continued)

FOREIGN PATENT DOCUMENTS

CN 2674698 Y 1/2005
CN 1685567 A 10/2005
(Continued)

OTHER PUBLICATIONS

Korean Office Action dated Sep. 1, 2021 for corresponding Korean Application No. 10-2020-7018883 and English translation.
(Continued)

*Primary Examiner* — Vanessa Girardi
(74) *Attorney, Agent, or Firm* — Pearne & Gordon LLP

(57) ABSTRACT

The application relates to a connector, intended to transmit radio frequency RF signals, of longitudinal axis X, including: a central contact under the form of an elongated flat strip which at least one of its ends is shaped as a fork with two flexible branches to define inwardly a cavity extending along the axis X for receiving a contact pin of one complementary connector, the two flexible branches of the fork being configured such that to apply a contact force to the contact pin; at least one solid insulating structure in which the central contact is mechanically retained, one of its ends of the insulating structure being configured to let the two flexible branches to move freely radially and to guide the contact pin while enabling its swivelling when inserted into the cavity (C) defined by the fork.

15 Claims, 4 Drawing Sheets

(56) References Cited

U.S. PATENT DOCUMENTS

| | | | | |
|---|---|---|---|---|
| 10,658,803 | B2 * | 5/2020 | Gartmann | H01R 13/506 |
| 2004/0038586 | A1 | 2/2004 | Hall et al. | |
| 2009/0004925 | A1 | 1/2009 | Su et al. | |
| 2019/0165525 | A1 | 5/2019 | Gartmann | |

FOREIGN PATENT DOCUMENTS

| | | | |
|---|---|---|---|
| CN | 206585114 | U | 10/2017 |
| CN | 109075477 | A | 12/2018 |
| JP | 05-059773 | U | 8/1993 |
| KR | 10-2019-0004704 | A | 1/2019 |

OTHER PUBLICATIONS

International Search Report for corresponding International Application No. PCT/CN2019/077537 dated Dec. 10, 2019.
Written Opinion for corresponding International Application No. PCT/CN2019/077537 dated Dec. 10, 2019.
Extended European Search Report dated Aug. 31, 2021 for corresponding European Application No. 19877537.1.
Chinese Office Action dated Feb. 22, 2022 for corresponding Chinese Application No. 201980004682.4 and English translation.

* cited by examiner

RF CONNECTOR COMPRISING A FLAT CENTRAL CONTACT WITH A FORK SHAPED END AND A SOLID INSULATING STRUCTURE CONFIGURED TO GUIDE A COMPLIMENTARY CONTACT PIN, APPLICABLE FOR USE IN A BOARD TO BOARD CONNECTOR

TECHNICAL FIELD

The present invention relates to a connector, intended in particular to transmit radio frequency RF signals.

In the framework of the invention the term "connector" includes a plug or jack, a receptacle, an adaptor as well as a bullet.

The applications particularly targeted by the invention are the connection of telecommunication equipment such as base transceiver stations BTS, RRU/RRH (remote radio unit/remote radio head) units and distributed antenna system for the wireless communications market.

The invention also relates generally to the connectors in the medical domain, the industrial domain, the aeronautical domain, the transport domain and the space domain.

The connectors according to the invention can be used in particular to link two parallel printed circuit boards, usually called a board-to-board connecting system or even a printed circuit board to another component such as a module, a filter or a power amplifier or an antenna.

The invention more particularly aims to propose a RF connector which is less expensive to manufacture than the RF coaxial connectors according to the prior art, while achieving better radio-frequency performance as well as enabling bigger axial and angular misalignment.

PRIOR ART

Radio frequency (RF) coaxial connectors are usually installed on cables or signal transmission devices, and separable components for electrical connection of transmission line systems can be used for circuit board to circuit board, circuit board (PCB) to RF module or RF module to RF module interconnection.

One of the trend in this market is that the tolerances of the relative positions between the PCB(s) and/or module(s) are getting larger and larger. The connecting components have to integrate these growing tolerances while being, easier to manufacture and lower in cost.

Existing RF coaxial connectors typically include a central contact, an outer contact, and a solid insulating structure arranged between the central contact and the outer contact, the central contact being supported by the insulating structure to avoid contact with the inner wall of the outer contact and get suitable relative coaxial position with the outer contact.

Existing RF coaxial connectors are largely used as components of connection assemblies intended for the so-called board-to-board connections.

A first generation of connection assemblies is thus known, for directly interconnecting boards, for example marketed under the names SMP, SMP-Com, MMBX from the Radiall company. Such connection assemblies respectively consist of a first receptacle of snap-fitting (or "snap") type, a second receptacle of "sliding" (or smooth bore) type with a guiding cone ("slide on receptacle"), and a connection coupling called adaptor, with the first and second receptacles respectively fastened to the ends thereof. The connection is therefore made blind by the re-centering of the connection coupling by means of the guiding cone of the sliding receptacle. The major drawback is the great limitation on the axial and radial misalignments allowed for these connections. In practice, the axial misalignment is limited to a few tenths of a millimeter, of the order of 0.3 mm to 0.6 mm, in order to keep the impedance of the coaxial line at a value equal to 50 Ohm. The radial misalignment is obtained by a rotation of the coupling in the groove of the snap-fitting receptacle, this rotation being in fact relatively small to avoid damaging the central contact and the elastic means with which the connection coupling is provided.

A second generation of connection assemblies is also known, for example marketed under the names SMP-MAX by the Radiall company or else marketed under the names MBX by the Huber & Suhner company or else marketed under the name AFI by the Amphenol RF company, or else marketed under the name Long Wipe SMP and P-SMP by the Rosenberger company.

Such connections, to link two printed circuit boards, generally consist of three elements, namely: a first receptacle of sliding type, a second receptacle with snap-fitting or of retention type and a connection coupling or adaptor with the first and second receptacles respectively fastened to the ends thereof.

The contacts of the elements are conventionally made of brass, bronze or CuBe2 and may be provided at their ends with elastic means (petals and slots for example) that cooperate with the contacts of their counterpart element.

However, all the known board-to-board connections do present a significant number of drawbacks due to the conception of the RF coaxial components.

More particularly, the existing central contacts for constituting RF coaxial connectors are mostly axisymmetric components, under the form of slotted sleeves for the female contacts and under the form of pins for the male contacts.

This implies major drawbacks.

Firstly, a slotted sleeve has not only high production cost, but also has high processing requirements. More particularly, the central female contact has an inner hole at the end, and in most cases, the inner hole is a blind hole. After the turning process, the fluid, that is used for cutting, needs to be cleaned, which is difficult to be properly cleaned, and the inner hole is black after the heat treatment when incorrect cleaning and presence of residues. When applying an electroplating process, the inner hole is not easily plated with a plating layer to cover the residues. Besides, at the time of electroplating, the central female contact has a large difference in current density between the interior of hole and the exterior of the hole. Generally, the current density outside the hole is high, the plating layer is thick, the current density in the hole is low, and the plating layer is thin. At the same time, the plating solution in the hole is difficult to be recycled, and the plating material is not easily replenished after being consumed, and the plating layer in the hole is further thinned than the outside the hole.

In order to ensure sufficient thickness of the plating layer in the hole, the entire product must be plated with a thick plating layer, which consumes a large amount of electroplated precious metal, consumes a large amount of energy, has a long working time, and has a high cost. However, the product can only be plated by vibrating or the like in the barrel.

Even when the center contact has no hole like the male pin, the current density at the end and middle of the pin is different by vibrating plating or the plating like in the barrel. High current density at the end of pin generate high plating thickness while low current density at the middle generate thin plating thickness at the middle of pin. That is the reason why the thickness of the plating layer of the entire product must be increased again, resulting in waste of plating materials, working time and electricity.

Secondly, a slotted sleeve can be difficult to be mounted and fixed notably in rotation, so that the assembled RF coaxial connector can be damaged.

Moreover in this existing design, the slotted sleeves of the central contact of a given connector which guides the contact pin of the complementary connector during the connection process, makes possible a relatively small allowable tilting angle between the two contacts.

Due to that for example in a board-to-board connecting system, the positioning tolerances of the complementary connectors must be relatively high, and therefore the RF performances may be lowered. Moreover the mechanical resistance of the connection system are reduced when repetitive connections.

There is therefore a need to further improve the RF connectors, with less production costs, which is easier to assemble and accepts higher misalignment tolerances of the equipment while maintaining their mechanical resistance.

The invention aims to address all or some of these needs.

EXPLANATION OF THE INVENTION

The subject of the invention is thus a connector, intended to transmit radio frequency RF signals, of longitudinal axis X, comprising:

- a central contact under the form of an elongated flat strip which at least one of its ends is shaped as a fork with two flexible branches to define inwardly a cavity extending along the axis X for receiving a contact pin of one complementary connector, the two flexible branches of the fork being configured such that to apply a contact force to the contact pin;
- at least a solid insulating structure in which the central contact is mechanically retained, one of its ends of said insulating structure being configured to let the two flexible branches to move freely radially and to guide the contact pin while enabling its swivelling when inserted into the cavity defined by the fork.

Thus, the invention mainly consists in the combination of a plane central contact with flexible branches to apply a contact force to a male pin of a complementary connector, and an insulator which serves as a guide and a centring of the male pin and enables its swivelling/tilting which authorizes radial misalignment between the two complementary connectors.

In another words, in a connector according to the invention the mechanical function of guiding and centring a contact pin is ensured by the insulator around the flat central contact. At least one end of this flat contact is shaped as a fork with flexible branches to apply a radial force against the contact pin in order to ensure the electrical function, i.e. to transmit radio frequency signals.

Compared to all the RF coaxial connectors of the prior art such as described in the preamble, the production costs of a connector according to the invention are reduced, because the central contact may be manufactured by low cost processes, more particularly by cutting from stamping of metal sheets.

Other benefits are derived from this manufacturing process:

- as the flat central contact is not an axisymmetric piece of revolution, there is no need of internal hole to be designed;
- the flat central contact is easy to clean after the cut processing;
- no residues after heat treatment and/or imperfect electroplating is feared;
- a uniform and thin thickness of a plating layer can be achieved;
- the thinnest part of the plating layer can easily reach the specifications;
- a selective plating can be easily applied due to stamping part with carrier with gold-plated, silver-like and other precious metal materials only at the contact area with male pin of the flat central contact and with very thin precious metal materials or other inexpensive plating materials (such as tin, nickel, nickel-phosphor alloy, copper-tin-zinc alloy), at the other portions of the flat central contact. said selective plating guarantees product performances, while greatly saving electroplated precious metal materials, which reduces costs;
- the plating process is less time, materials and energy consuming.

In a preferred embodiment, the central contact is a symmetric structure with each of its two ends shaped as a fork, the connector comprising two solid insulating structures, one of the ends of each of the two insulating structures being configured to let the two flexible branches of one of the ends of the central contact to move freely radially and to guide the contact pin of one complementary connector while enabling its swivelling when inserted into the cavity (C) defined by the fork.

In an advantageous variant, the inward cavity of the fork is shaped as a frusto-conical, in order to allow the swiveling of the contact pin of the complementary connector. According to this variant, the inner cavity of the insulating structure is also preferably shaped as a frusto-conical, or at least with an inner volume to allow the free displacement of the branches of the fork, in order to let it possible the swiveling of the contact pin of the complementary connector.

Preferably, the central contact is made of a piece of cut flat metal made of an elastic material, preferably made of aged hardened $CuBe_2$. This has the advantage to do no need any heat treatment.

In an advantageous variant, the inner surface of the ends of each branch of the fork is a V-shaped groove surface or a circular arc surface which can guarantee good contact with cylinder male pin. The outer projection at outer surface gives good support to prevent excessive deformation of two flexible branches.

Preferably, the fork and the solid insulating structure are arranged such that the end of the branches are located in the same plane of the end face of the solid insulating structure.

In an advantageous embodiment, the solid insulating structure has a substantially cylindrical cavity radially extended by two diametrically opposite slots in each of which one of the two branches of the fork is arranged and free to move up to the bottom of a slot. The slots of the insulating structure are advantageously sized to prevent excessive radial and circumferential deformation of the branches of the central contact.

Advantageously, the solid insulating structure has an inner chamfer between the cylindrical cavity and its end face.

In an advantageous variant, the central contact has at least one outer projection, called harpoon, which is mechanically retained into an inner groove of the solid insulating structure.

In another advantageous embodiment, the connector further comprises an outer contact forming a body, preferably made of $CuBe_2$, in which the solid insulating structure is mechanically retained, notably by punches.

According to this embodiment, the outer contact is preferably slotted at least one of its ends, defining contact petals.

The invention also concerns a connection assembly, intended in particular to link two printed circuit boards, comprising:

- a connector such as described above, called bullet, forming a connection coupling;
- a first receptacle, intended to be brazed or welded to a first printed circuit board, said first receptacle comprising a pin central contact,
- a second receptacle, intended to be brazed or welded to a second printed circuit board, said second receptacle comprising a pin central contact, wherein the pin central contact of the first receptacle is inserted into one of the end fork of the flat strip central contact of the connection coupling whereas the pin central contact of the second socket is inserted into the other end fork of the central contact of the connection coupling.

According to an advantageous embodiment, the connection coupling is a symmetric structure with one of its end surfaces being fixed in the first receptacle whereas the other end is floating mounted in the second receptacle.

DETAILED DESCRIPTION

Other advantages and features of the invention will become more apparent on reading the detailed description of exemplary implementations of the invention, given as illustrative and non-limiting examples with reference to the following figures in which.

In clarity purposes, the same references designating the same elements of a connector according to the invention are used for all the FIGS. 1 to 4.

Figure 1:
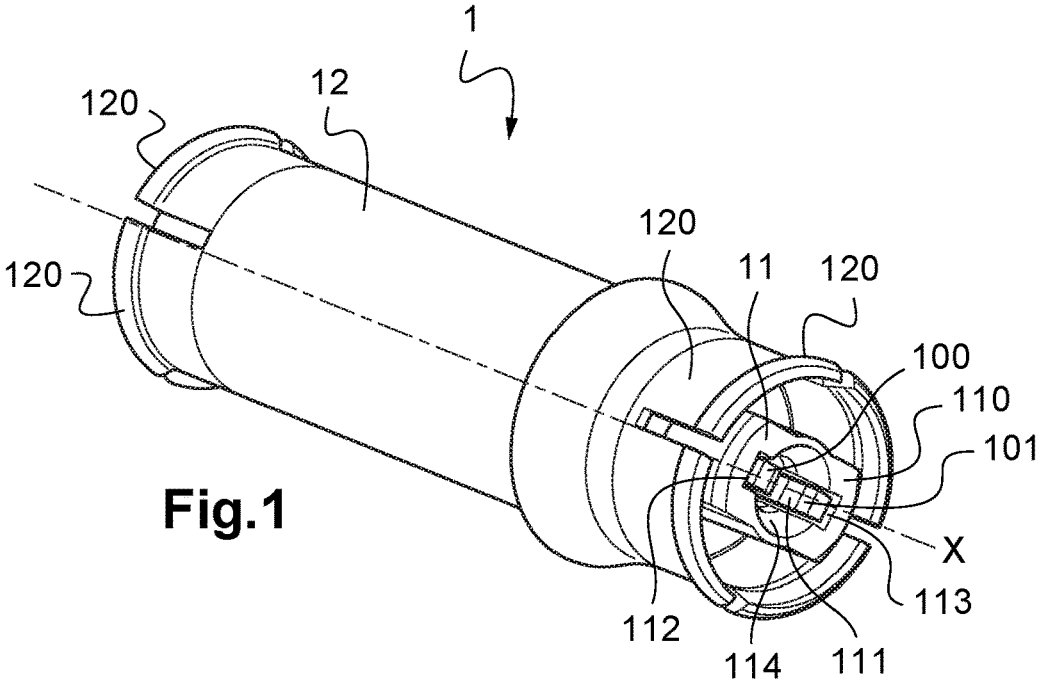
FIG. 1 is a perspective view of a RF connector according to the invention, forming a coupling connection.

Hereinafter, the invention is described with reference to any type of RF line.

The RF connector 1 according to the invention is of longitudinal axis X and has a symmetric structure.

The RF connector 1 comprises, as components, a flat central contact 10, an outer contact 12 forming a body/casing, and two identical electrical insulating solid structures 11 interposed between the flat central contact 10 and the outer contact 12.

As described below, the flat central contact 10 is mechanically retained by the insulating structures 11 and the shape and the sizing of these components allow them to support any part of the central contact 10, notably to prevent excessive deformation of it.

The solid insulating structures 11 are mechanically retained into the outer contact 12 and the shape and the sizing of the insulating structures 11 allow them to support any part of the outer contact 10, notably to prevent excessive deformation of it at any direction (radial and circumferential direction).

The flat central contact 10 has a sheet-like structure, formed by punching to form the desired shape, with the functions of RF signal transmission together with the ground contact through the insulating structures (including air), of conformance to dimensional characteristics requested by the equipment and of conformance to mechanical performances and assembling requests.

Preferably, the central contact is made of a piece of cut flat metal, preferably made of aged hardened $CuBe_2$.

More precisely, the central contact 10 is a symmetric structure with each of its two end surfaces shaped as a fork.

A fork comprises two flexible branches 100, 101 to define inwardly a cavity extending along the axis X. This cavity is intended to receive a contact pin 20; 30 of a complementary connector 2;3.

Figure 5:
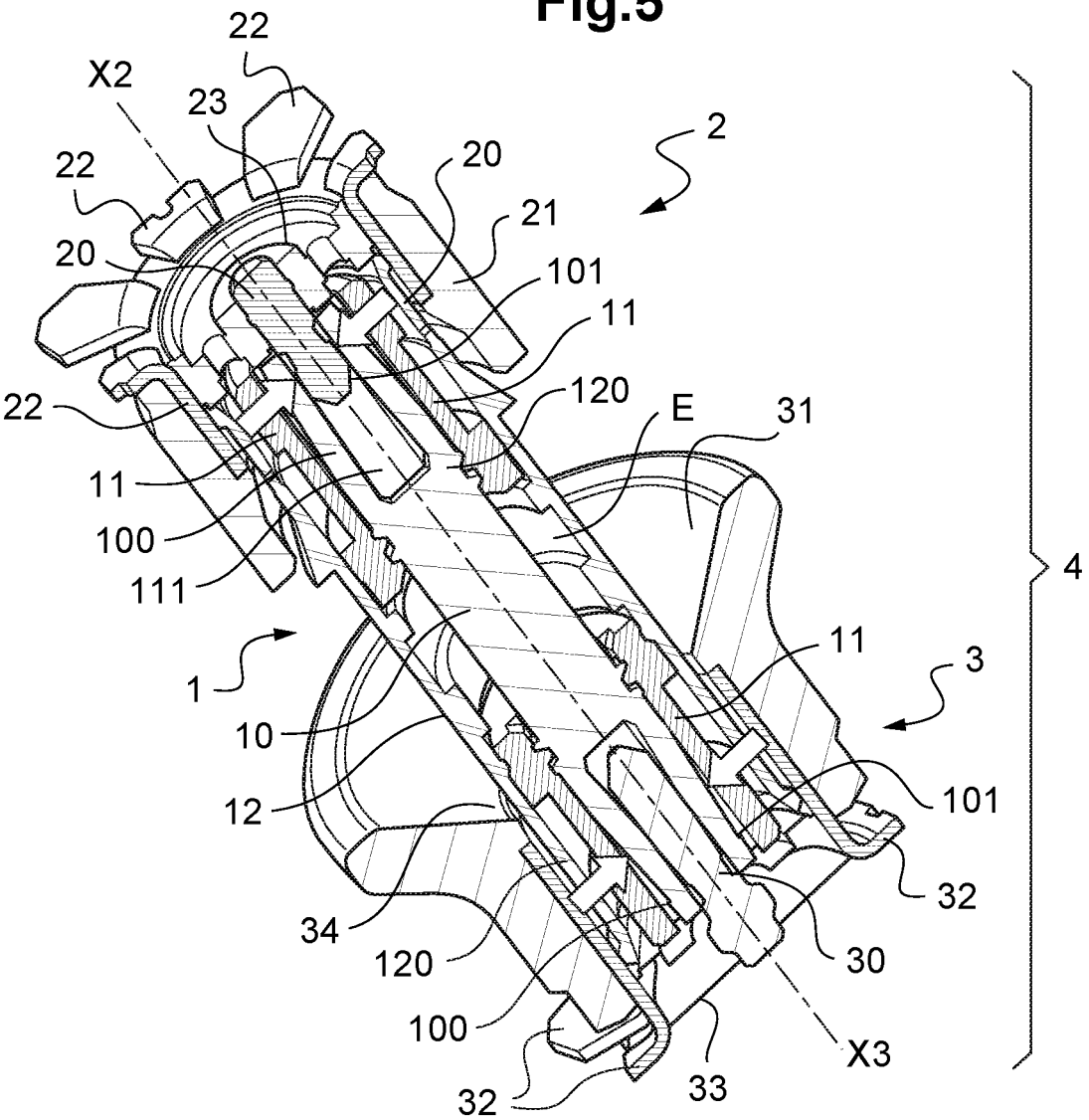
FIG. 5 is a longitudinal cross-sectional view of an exemplary connection assembly, intended to link two printed circuit boards comprising two receptacles joined with a connector forming a connection coupling according to the invention.

The extremities of the two flexible branches 100, 101 of the fork are configured such as to apply a contact force to the contact pin 20; 30, said force being normal to the axis X, as shown by the symbolised arrows on FIG. 5. This contact force shall be maintained whatever the specified maximum angle of swivelling with the counterpart pin 20, 30. This angle may be of the order of some degrees.

This ensures a good electrical resistance between the central contacts of the connector 1 of the invention and a complementary connector 2, 3 and the good transmission of the RF signals. The shape of the flat central contact 10 is adjusted for the impedance matching at a given frequency range, for example from 0 to 6 GHz.

Moreover, the middle parts of the branches are designed in order to define a inner cavity C which volume allows the counterpart pin 20, 30, to be tilted with the specified maximum angle.

Figure 3:
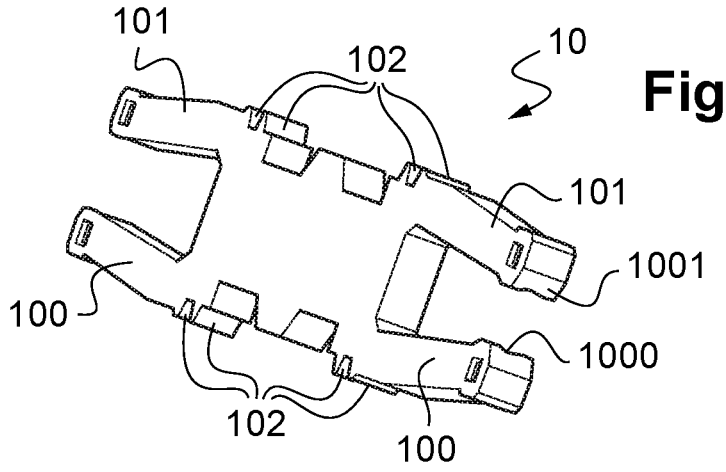
FIG. 3 is a perspective view of a flat central contact according to the invention.

Advantageously, in order to increase the contact area or the number of contact points between the flat central contact 10 and a complementary contact pin 20; 30, the inner surface 1000, 1001 of the end of each branch 100, 101 of a fork is a V-shaped groove surface or a circular arc surface (FIG. 3). These surfaces improve the electrical performance, and also improve the alignment of the pin 20; 30 into the flat central contact 10, and give to the complementary contact pin 20, 30 a good position when there is radial misalignment or tilt angle mating.

In its central portion, the flat central contact 10 has a plurality of outer projections or harpoons 102 which are each mechanically retained into an inner groove 115 of one solid insulating structure 11. These projections or harpoons 102 can apply a retention force with the corresponding inner grooves of the insulator 7. A plurality of harpoons enhance the retention force and at the same time make the flat central contact 10 more stable when this latter is elongated and the force has been apply inwardly along axis when mating.

Figure 1A:
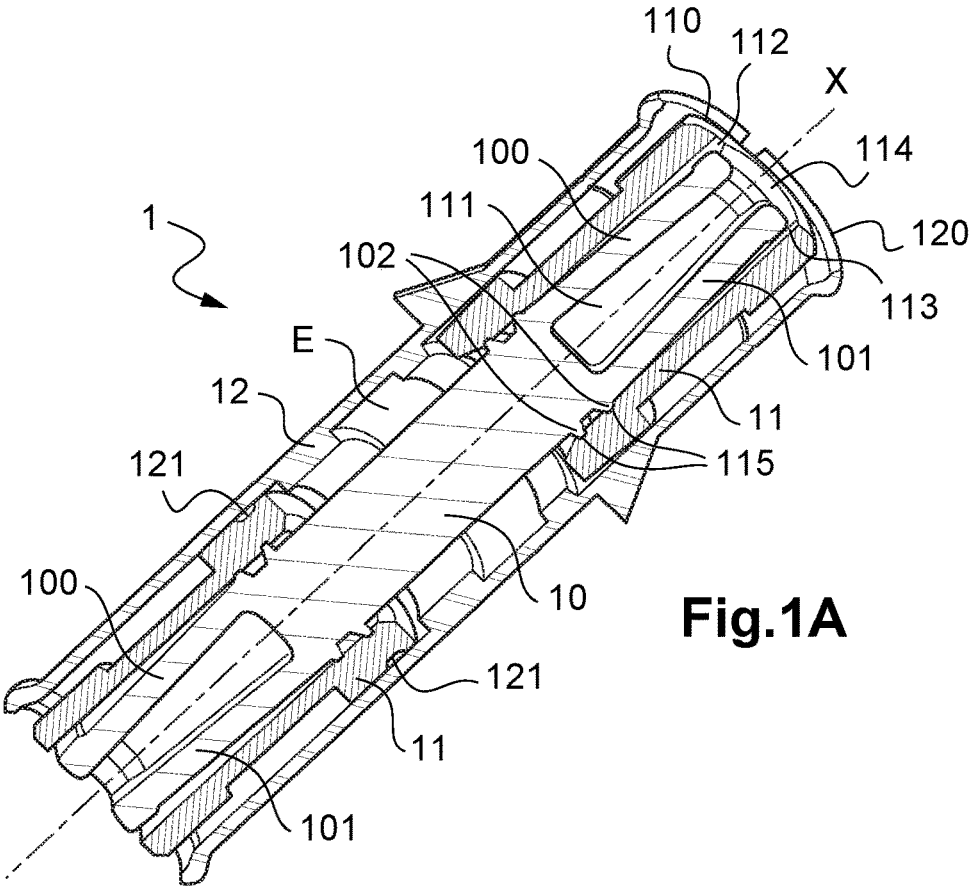
FIG. 1A is a longitudinal cross-sectional view of the connector according to FIG. 1.
Figure 1B:
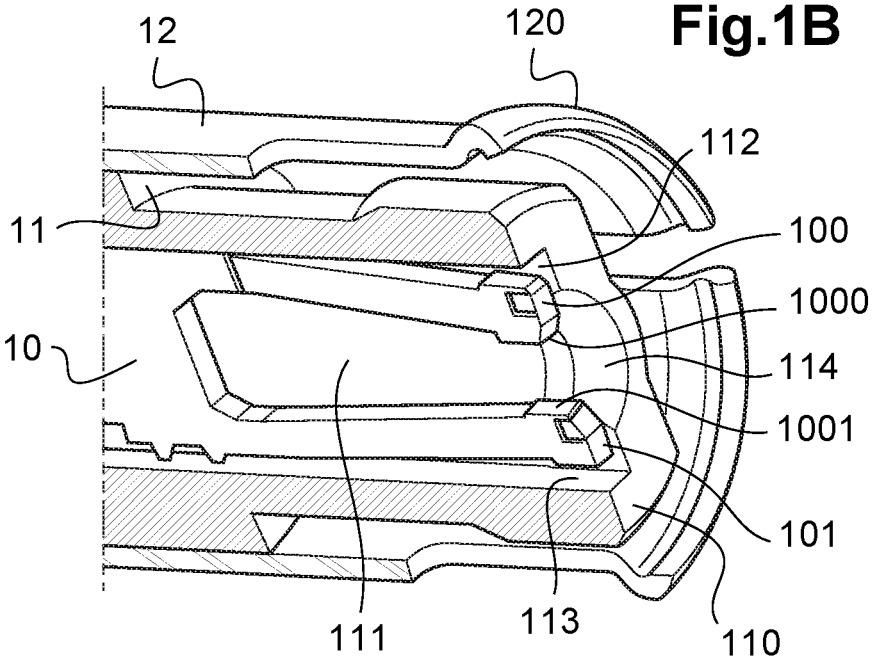
FIG. 1B is a detail view of one end of the connector according to FIGS. 1 and 1A.
Figure 2:
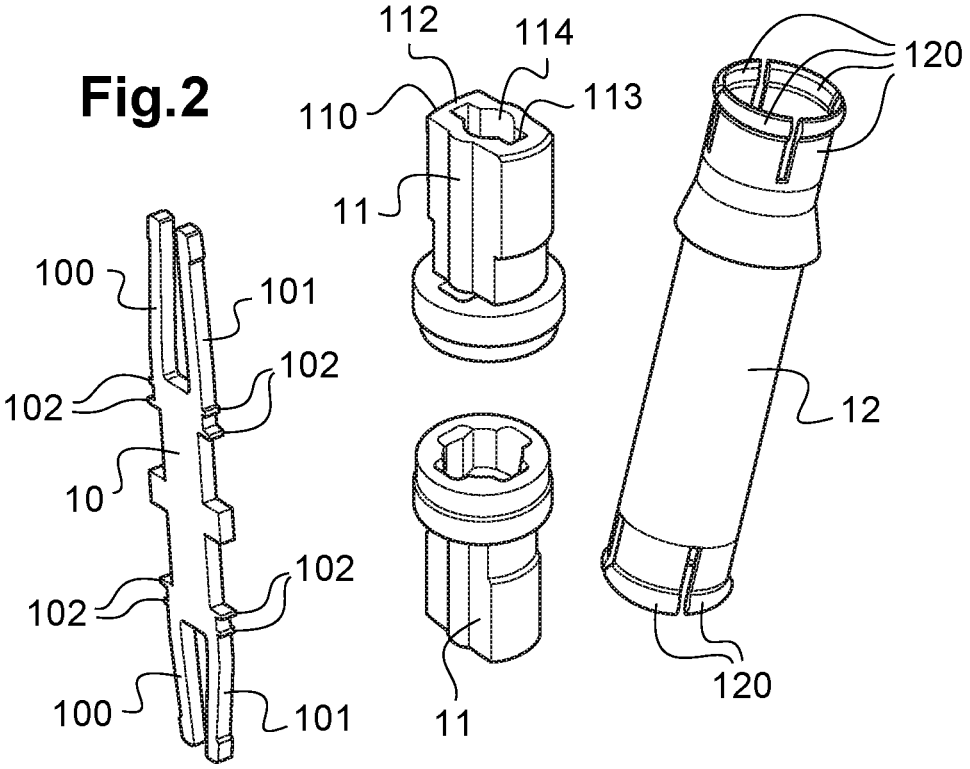
FIG. 2 shows in perspective views all the components of the RF connector according to FIGS. 1 to 1B.
Figure 4:
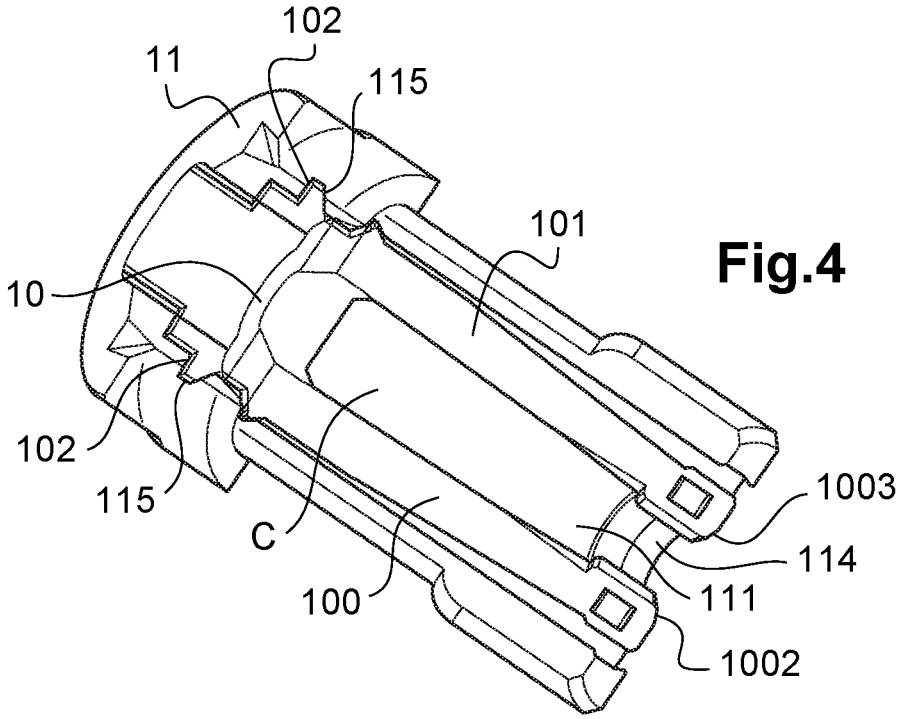
FIG. 4 is a longitudinal cross-sectional view of a variant of a connector according to the invention.

In the shown example, each lateral side of the central portion of the central contact 10 has two projections 102 to be retained mechanically into inner grooves 115 (FIGS. 1A, 4). The mechanical interference between the projections 102 and the insulating structure 11 increase the holding force between these two components without increasing the interference mating condition between them. These holding forces allow also the centring of the central contact 10 into the insulating structure 11. The projections 102 are preferably realized by cutting the metal sheet during the stamping of the central contact 10.

Each insulating structure 11 is an axisymmetric body which closely abuts both the inner surface of the outer contact 12 and the outer surface of the central contact 11.

According to the invention, a solid insulating structure 11 is configured with an inner hole and inner grooves inside the hole to let the flexible branches 100, 101 to move freely radially and to guide the contact pin 20; 30 while enabling its swivelling when inserted into the cavity defined by the fork.

In other words, according to the invention, the guiding and centring of the complementary contact pin 20; 30 is ensured exclusively by the solid insulating structure 11.

More precisely, the solid insulating structure 11 has a substantially cylindrical cavity 111 radially extended by two diametrically opposite slots 112, 113 in each of which one of the two branches 100, 101 of the fork is arranged and free to move up to the bottom of a slot 112, 113 (FIGS. 1, 1A, 1B, 5). The sizing of the slots 112, 113 prevents excessive radial and circumferential deflexion of the branches 100, 101 of the central contact 10. Indeed, in case of important deflexion of one branch 100, 101 when misalignment, the bottom of the corresponding slot 112, 113 serves as an abutment and thus prevents any excessive deformation.

In order to improve the guiding of the contact pin 20; 30, the solid insulating structure 11 has an inner chamfer 114 between the cylindrical cavity 111 and its end face 110.

Correspondingly, there is an inner chamfer 1002, 1003 at the end of each of the two branches 100, 101 of the fork 10 (FIG. 4). These chamfers work as lead-in when the contact 10 mates with one of the complementary contact pin 20 or 30.

FIG. 4 shows also an advantageous general shape of the inward cavity of the fork 10. This cavity C is shaped as a frusto-conical. This allows the swivelling of the pin 20 or 30, when inserted into the cavity. In other words, a frusto-conical shape C guarantees a tilt angle for the pin 20 or 30.

Preferably, the inner cavity 114 of the insulating structure 11 is also shaped as a frusto-conical, or at least with an inner volume to allow the free displacement of the branches of the fork, in order to let it possible the swiveling of the pin 20 or 30.

Thus, the diameter of the insulator inner hole at end of connector side is a little smaller than at the connector inward side. The width of the cavity C at the end is smaller than the width at the bottom. The width of the cavity at the end is smaller than the diameter of complementary contact pin 20; 30 while the width of the cavity at the bottom is bigger than the diameter of complementary contact pin 20 or 30.

This smaller hole longitudinal segment in insulator 11 guarantees the good positioning of the complementary contact pin 20 or 30. These two stepped holes are coaxial. The bigger hole longitudinal segment in the insulator 11 and the bigger width at the cavity bottom on flat central contact 10 allow to the complementary contact pin 20 or 30 to swivel when inserted into the cavity defined by the fork 10.

In the direction perpendicular to flat surface of flat central contact 10, there is no metal material at the cavity longitudinal segment. It means that the swivelling angle along this direction can be much bigger than a usual cylinder female socket which is manufactured by machining process.

The thickness at the section view of inner grooves in insulator 11 at end of connector side is bigger than that at connector inward side. These two stepped grooves have same axis. The narrow grooves in insulator 11 is suitable to the thickness of the flat central contact 10 and can hold the flat central contact 10 in it. The narrow grooves in insulator 11 will guide and locate the flat central contact 10 to guarantee a gap between the insulator 11 at wider inner grooves area and the flat central contact 10 at the flexible branches 100, 101 area. The gap will allow to the flexible branches 100, 101 to move freely radially during mating and un-mating with the complementary contact pin 20 or 30.

The inner grooves of the insulator 11 can have several segments of different width. The first segment at the connector inward side is wider than other segments. It can have clearance mating condition with the harpoon 102 on the flat central contact 10. The purpose of these segments of grooves of different widths is for the pre-assembly. Indeed, the pre-assembly may be done manually.

One the pre-assembly has been achieved, a machine may be embodied to further assembly the flat central contact 10 into the insulator 11. This machine can apply a bigger force than manually in order to obtain an interference mating condition between the other segment of grooves 115 in the insulator 11 and the harpoon 102 on flat central contact 10 to obtain a good retention force.

Preferably, a fork of a central contact 10 and the corresponding solid insulating structure 11 are arranged such that the end of the branches 100, 101 are located in the same plane of the end face 110 of the solid insulating structure 11 (FIGS. 1, 1A, 1B, 4).

The outer contact 12 supports and protects the insulating structures 11. To ensure the electrical contact at the ends of the outer contact 12, this latter is slotted at its ends defining contact petals 120. The petals 120 may be thicker than the thickness of the rest of the contact 12. Due to this increase of the thickness, the electrical resistance is reduced and the mechanical resistance is stronger.

To retain the solid insulating structures 11 into the outer contact 12, punches 121 may be realized.

As shown on FIGS. 1A and 5, it may be provided a space E filled with air, and hence without solid insulating structure, between the outer contact 12 and the central contact 10, in the central portion of the connector 1. This conception allows to have different lengths of connectors 1 by using same solid insulating structures 11, while preserving an adapted characteristic impedance all along the connector 1. In another embodiment, especially for short connector; the insulator structure may be constituted of the half parts sandwiching the central contact along the connection axis.

The connector 1 which has been described is advantageously used as a connection coupling 1 into a connection assembly or module 4 used to link two parallel printed circuit boards, i.e. into a board-to-board connecting system 4.

FIG. 5 shows the connection coupling 1, usually called bullet, according to the invention, the first receptacle 2 and the second receptacle 3 and of the connection assembly 4.

The first receptacle 2 is intended to be brazed or welded to a first printed circuit board. The first receptacle 2 of longitudinal axis X2 comprises a contact pin 20, a rigid body 21 with a recess, and a plurality of peripheral contacts 22 maintained into the rigid body 21 and arranged at the periphery of the contact pin 20.

The plurality of peripheral contacts 22 forms a ground contact.

An insulator 23 is positioned between the contact pin 20 and the ground contact 22.

The recess of the body 21 houses the contact pin 20, the ground contact 22 and the insulator 23.

The second receptacle 3 intended to be brazed or welded to a second printed circuit board. The second receptacle 3 of longitudinal axis X3 comprises a contact pin 30, a rigid body 31 with a recess, and a plurality of peripheral contacts 32 maintained into the rigid body 31 and arranged at the periphery of the contact pin 30.

The plurality of peripheral contacts 22 forms a ground contact.

An insulator 33 is positioned between the contact pin 30 and the ground contact 32.

The recess of the body 31 houses the contact pin 30, the ground contact 32 and the insulator 33.

The body 31 of second receptacle 3 is also a centring end piece comprising a centring surface 34. As illustrated in FIG. 5, the centring surface 34 is of annular shape and of circular section.

When the connection coupling 1 is connected to the first receptacle 2 and to the second receptacle 3, as illustrated in FIG. 5, the branches 100, 101 of each end of the central contact 12 are in forced contact respectively with the contact pins 20, 30 and the elastic ground contacts 22, 42 bear against the petals 120 of the connection coupling 1. The centring surface 34 of the second socket 34 cooperates with the elongate rigid outer contact 12 of the coupling 1 defining a sliding link.

In an advantageous embodiment, one of the end surfaces of the connection coupling 1 can be fixed in the first receptacle 2, notably by clipping the end of the outer contact 12 into the body 21, whereas the other end can be floating mounted in the second receptacle 3.

Even if the illustrated embodiment of FIG. 5 shows that the different axis X, X2 and X3 of the different components are aligned, the connection coupling 1 according to the invention allows significant radial misalignment of the connection assembly because the contact pins 20, 30 in contact with the branches 100, 101 of the flat central contact 1 are sufficiently free to move radially into the cavity 111 and the petals 120 of the outer contact 12 have a high degree of elasticity.

A significant axial tolerance of the connection assembly according to the invention can be obtained by virtue of the sliding link on the side of the second receptacle 3. This/these axial and/or radial misalignment(s) allow(s) a tolerance on the distance between the two elements to be connected by the connection assembly according to the invention, such as printed circuit boards PCB.

Other variants and enhancements can be provided without in any way departing from the framework of the invention.

If all the shown examples are about a connector serving as a connection coupling with a symmetric structure and both ends shaped as a fork which branches are free to move into a solid insulating structure, the invention concerns also a connector with only one end shaped as a fork with two branches and only one solid insulating structure.

Also, the invention applies to any connector with or without the presence of an outer contact.

The expression "comprising a" should be understood to be synonymous with "comprising at least one", unless otherwise specified.

What is claimed is:

1. A connector, intended to transmit radio frequency RF signals, of longitudinal axis X, comprising:

a central contact under the form of an elongated flat strip which at least one of its ends is shaped as a fork with two flexible branches to define inwardly a cavity extending along the axis X for receiving a contact pin of one complementary connector, the two flexible branches of the fork being configured such that to apply a contact force to the contact pin;

at least one solid insulating structure in which the central contact is mechanically retained, one of its ends of said solid insulating structure being configured to let the two flexible branches to move freely radially and to guide the contact pin while enabling its swivelling when inserted into the cavity (C) defined by the fork, wherein the solid insulating structure has a substantially cylindrical cavity radially extended by two diametrically opposite slots in each of which one of the two branches of the fork is arranged and free to move up to the bottom of the slot.

2. The connector according to claim 1, wherein an inner surface of an end of each branch of the fork is a V-shaped groove surface or a circular arc surface.

3. The connector according to claim 1, wherein the solid insulating structure has an inner chamfer between the substantially cylindrical cavity and its end face.

4. The connector according to claim 1, wherein the central contact has at least one outer projection, called harpoon, which is mechanically retained into an inner groove of the solid insulating structure.

5. The connector according to claim 1, wherein the fork and the solid insulating structure are arranged such that an end of the branches are located in the same plane of an end face of the solid insulating structure.

6. The connector according to claim 1, wherein the cavity of the fork is shaped as a frusto-conical, in order to allow the swiveling of the contact pin of the complementary connector.

7. The connector according to claim 6, wherein an inner cavity of the solid insulating structure is also shaped as a frusto-conical, or at least with an inner volume to allow the free displacement of the branches of the fork, in order to let it possible the swiveling of the contact pin of the complementary connector.

8. The connector according to claim 1, wherein the central contact is made of a piece of cut flat metal made of an elastic material.

9. The connector according to claim 8, wherein the central contact is made of aged hardened $CuBe_2$.

10. The connector according to claim 1, further comprising an outer contact forming a body, in which the solid insulating structure is mechanically retained.

11. The connector according to claim 10, wherein the outer contact is slotted at least one of its ends, defining contact petals.

12. The connector according to claim 10, wherein the outer contact forming the body is made of $CuBe_2$.

13. The connector according to claim 1, wherein the central contact is a symmetric structure with each of its two ends shaped as a fork, the connector comprising two solid insulating structures, one of the ends of each of the two solid insulating structures being configured to let the two flexible branches of one of the ends of the central contact to move freely radially and to guide the contact pin of one complementary connector while enabling its swivelling when inserted into the cavity (C) defined by the fork.

14. A connection assembly, intended in particular to link two printed circuit boards, comprises:

a connector according to claim 13, forming a connection coupling;

a first receptacle, said first receptacle comprising a pin central contact, a second receptacle, said second receptacle comprising a pin central contact, wherein the pin central contact of the first receptacle is inserted into one of the end fork of the flat strip central contact of the connection coupling whereas the pin central contact of the second receptacle is inserted into the other end fork of the flat strip central contact of the connection coupling.

15. The connection assembly according to claim 14, wherein the connection coupling is a symmetric structure with one of its end surfaces being fixed in the first receptacle whereas another end surface is floating mounted in the second receptacle.

* * * * *